US006386225B1

(12) United States Patent
Holtby

(10) Patent No.: US 6,386,225 B1
(45) Date of Patent: May 14, 2002

(54) MODULAR CATCH PAN FOR WELLHEADS AND A METHOD OF USE OF THE SAME

(76) Inventor: Quinn Holtby, 3166-111B Street, Edmonton, Alberta (CA), T6J 1G9

( * ) Notice: Subject to any disclaimer, the term of this patent is extended or adjusted under 35 U.S.C. 154(b) by 0 days.

(21) Appl. No.: 09/929,308

(22) Filed: Aug. 14, 2001

(51) Int. Cl.[7] ..... E21B 33/00; E21B 33/08

(52) U.S. Cl. ..... 137/312; 137/15.01; 137/315.01; 141/86; 166/81.1

(58) Field of Search ..... 137/15.01, 15.11, 137/312, 315.01; 141/86; 166/81.1

(56) References Cited

U.S. PATENT DOCUMENTS

| | | | | |
|---|---|---|---|---|
| 560,986 | A | 5/1896 | Grow | 166/81.1 |
| 1,507,628 | A | 9/1924 | Schuyler | 166/81.1 |
| 1,531,569 | A | 3/1925 | Rade | |
| 2,137,832 | A | 11/1938 | Cordes | 166/81.1 |
| 3,025,070 | A | 3/1962 | Copes | 277/39 |
| 4,026,749 | A | 5/1977 | Appelhans et al. | 156/252 |
| 4,394,022 | A | 7/1983 | Gilmore | 277/377 |
| 4,444,402 | A | 4/1984 | Escue et al. | 277/397 |
| 4,949,784 | A | 8/1990 | Evans | 166/81 |
| 5,062,193 | A | 11/1991 | Thompson | 29/426.6 |
| 5,121,794 | A | 6/1992 | Hibdon et al. | 166/81 |
| 5,121,796 | A | 6/1992 | Wigington, Sr. | 166/379 |
| 5,150,751 | A | 9/1992 | Burton et al. | 166/81 |
| 5,167,277 | A | 12/1992 | Evans | 166/81 |
| 5,228,506 | A | 7/1993 | Pearce | 166/81.1 |
| 5,343,943 | A | 9/1994 | Norris et al. | 166/81 |
| 5,377,748 | A | 1/1995 | Gayaut | 166/81 |
| 5,394,939 | A | 3/1995 | Walker | 166/81 |
| 5,551,511 | A | 9/1996 | Holtby | 166/81.1 |
| 5,634,485 | A | 6/1997 | Holtby | 137/15 |
| 5,937,947 | A | 8/1999 | Holtby | 166/81.1 |
| 6,102,086 | A | 8/2000 | Holtby | 141/86 |
| 6,286,593 | B1 | 9/2001 | Holtby | 166/81.1 |

*Primary Examiner*—George L. Walton
(74) *Attorney, Agent, or Firm*—Davis & Bujold, P.L.L.C.

(57) ABSTRACT

A modular catch pan for wellheads includes a rigid pan body consisting of two detachably coupled sections, the body having a circular opening. A plurality of split annular adaptor collars are provided. Each of the adaptor collars has the same outer diameter so that any one of them can be fitted into the circular opening. Each of the adaptor collars has an outer circumferential sealing surface adapted to form a seal with the circular opening of the body. Each of the adaptor collars has an inner circumferential sealing surface. The size of the inner circumferential sealing surface and the distance of the inner circumferential sealing surface from the outer circumferential sealing surface varies between adaptor collars. The modular catch pan can be adapted to fit any installation by selecting a suitable adaptor collar.

10 Claims, 4 Drawing Sheets

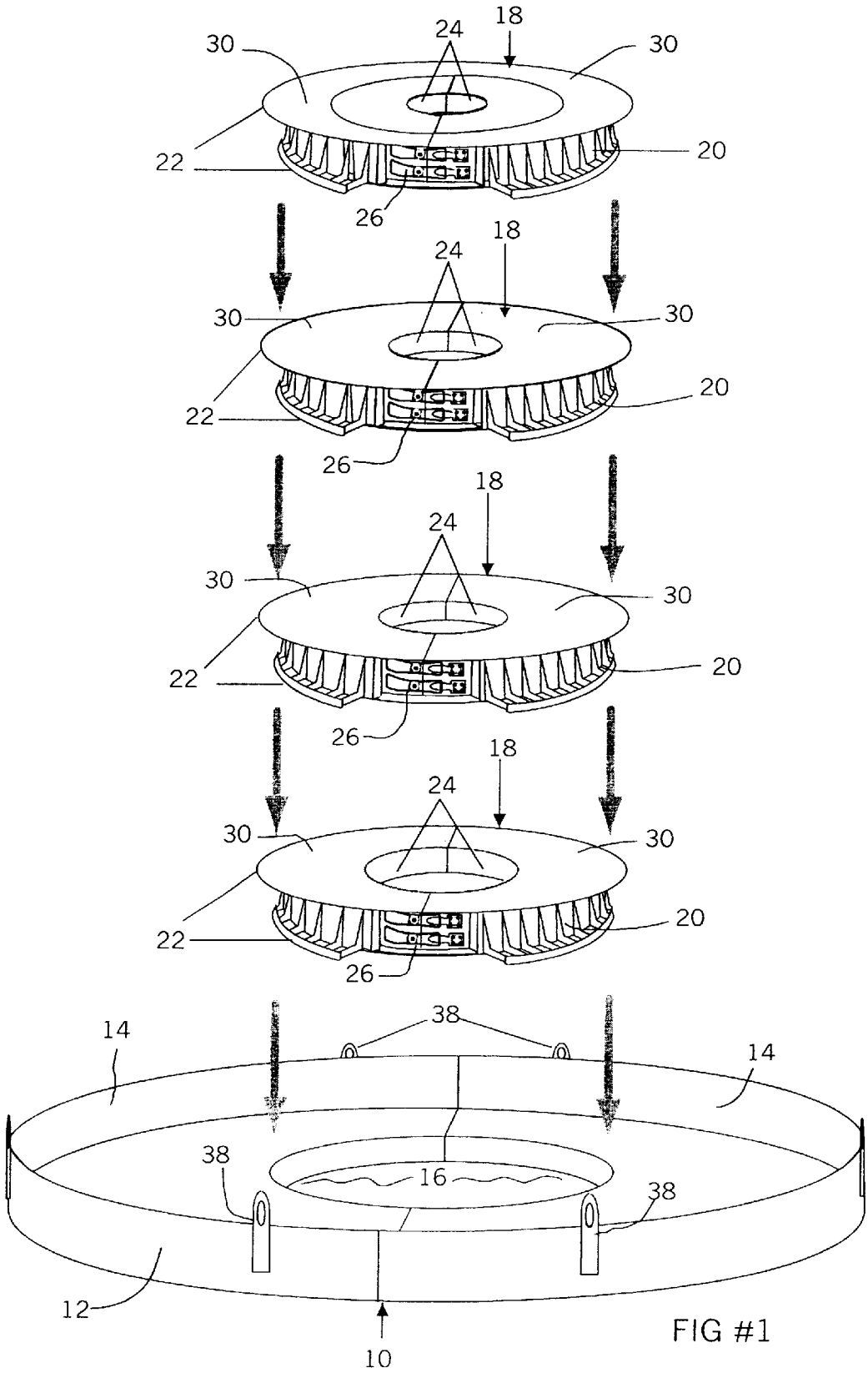
FIG #1

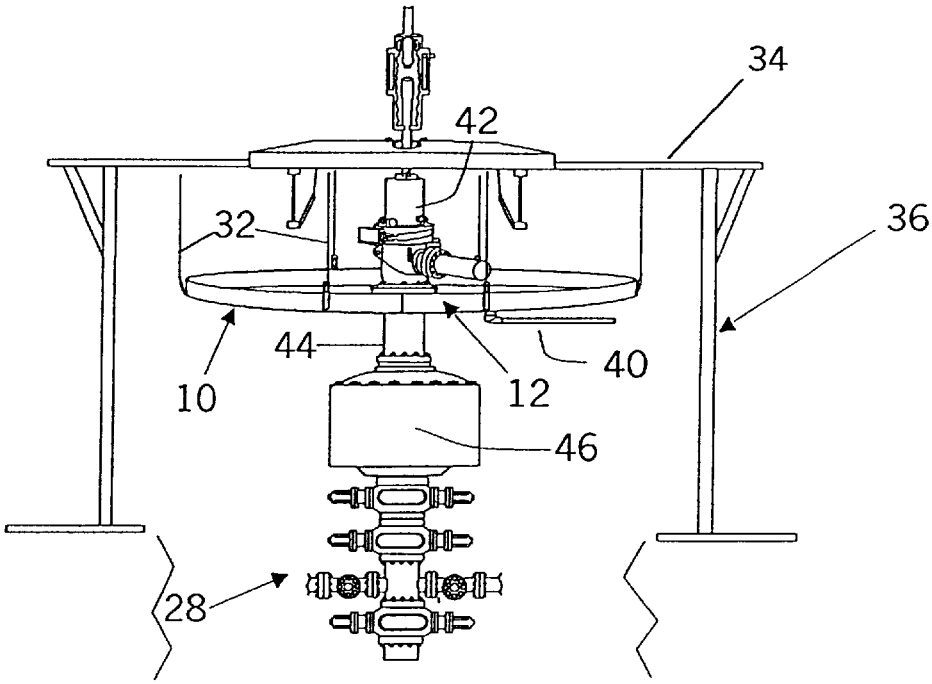
FIG #2
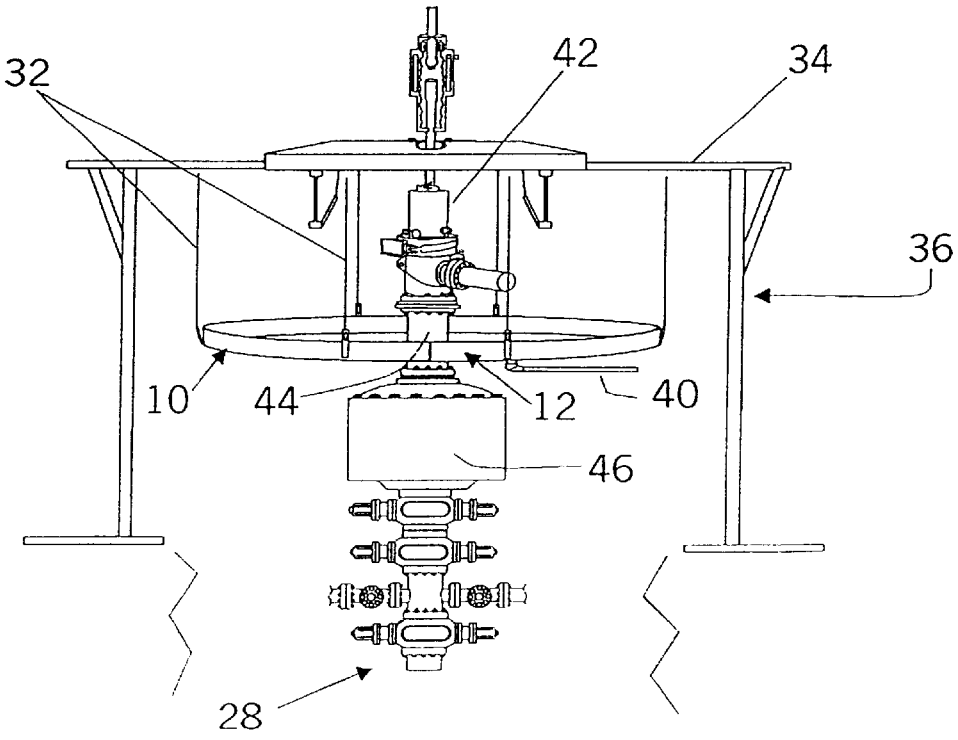
FIG #3

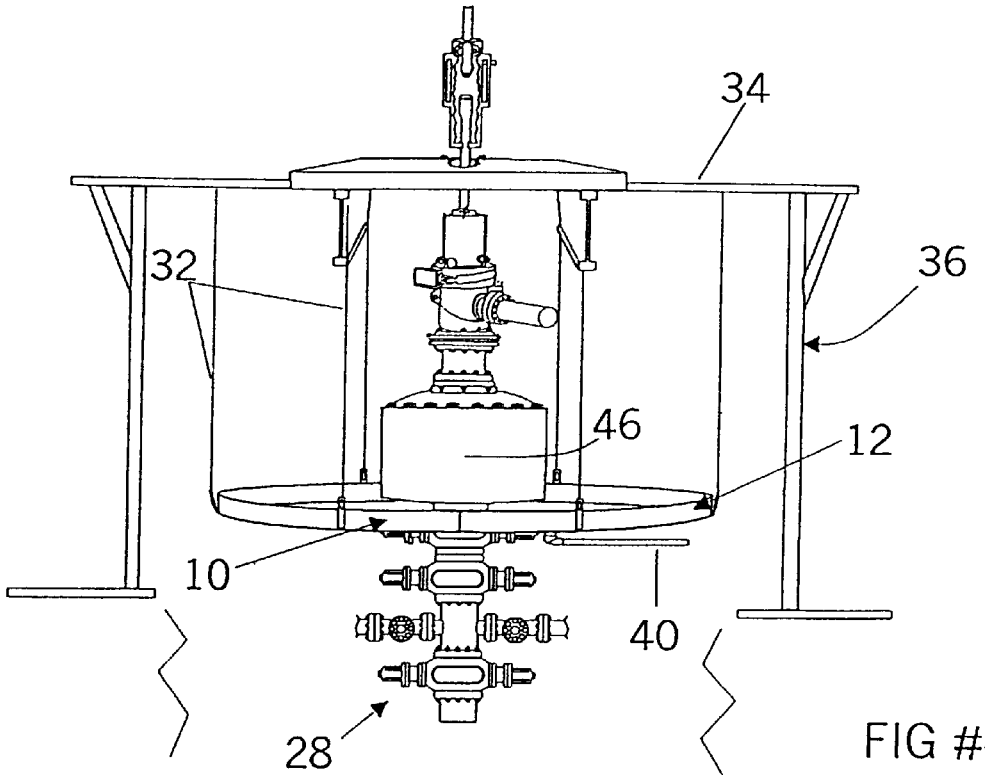
FIG #4
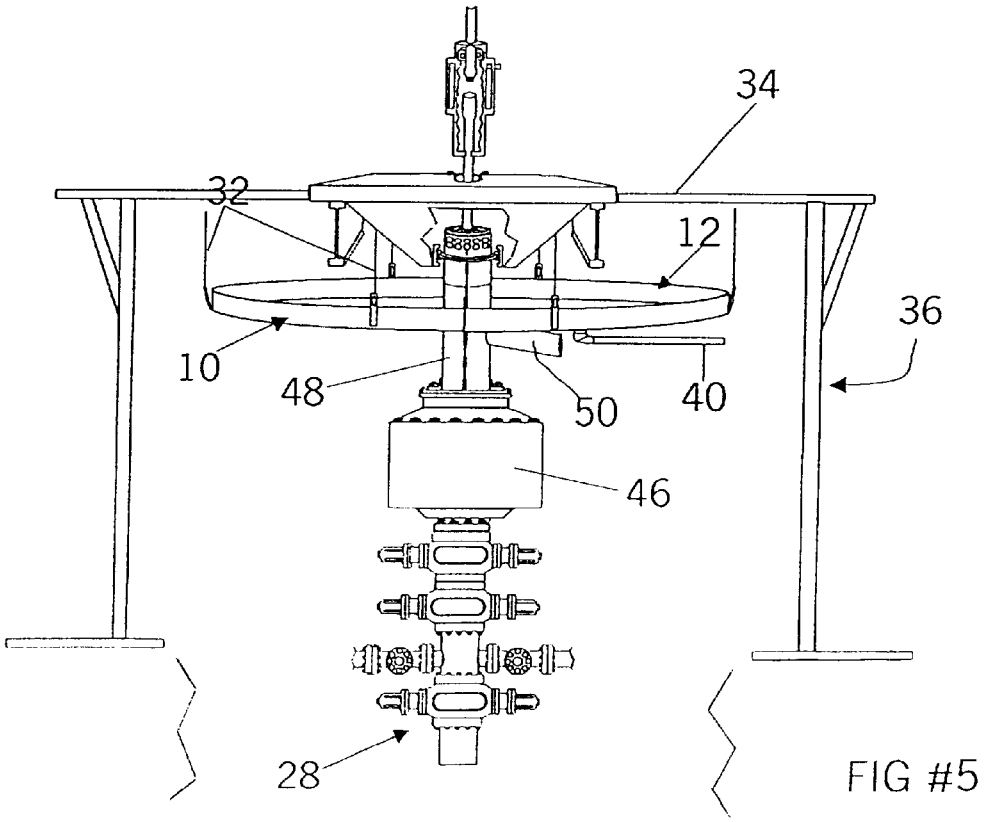
FIG #5

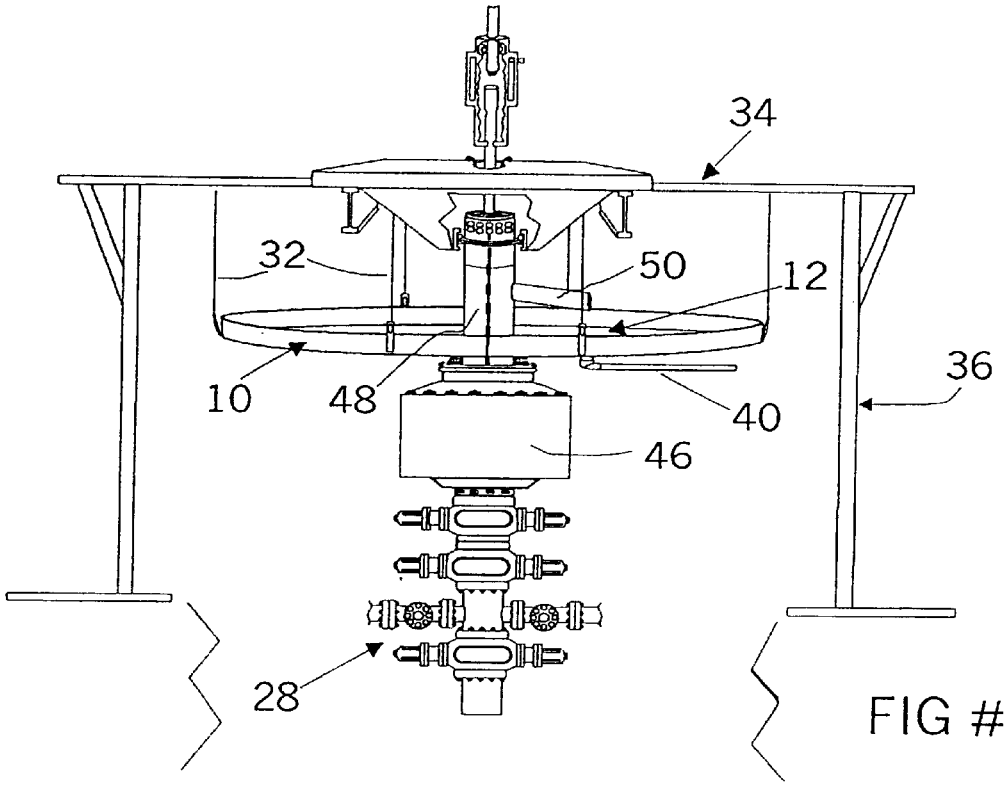
FIG #6

MODULAR CATCH PAN FOR WELLHEADS AND A METHOD OF USE OF THE SAME

FIELD OF THE INVENTION

The present invention relates to a modular catch pan for wellheads and method of use of the same.

BACKGROUND OF THE INVENTION

U.S. Pat. No. 5,634,485 (1997 Holtby) entitled "Method and apparatus for retrofitting drilling rigs with a catch pan" describes a drilling rig catch pan consisting of two mating sections. It also describes a manner of mounting the catch pan to a wellhead positioned below the drilling rig floor in order to prevent environmental contamination. When the Holtby apparatus was used in the field, it was discovered that for different wellhead configurations, the preferred position of the apparatus would vary. For some installations the apparatus was placed below a rotating head, on others on a spacer collar below the rotating head, on others below a hydril, on others on a flow nipple above the flow line, and on others on a flow nipple below the flow line.

SUMMARY OF THE INVENTION

The present invention relates to a modular catch pan that provided greater flexibility to adapt to different installation dimensions.

According to one aspect of the present invention there is provided a modular catch pan for wellheads which includes a rigid pan body consisting of two detachably coupled sections, the body having a circular opening. A plurality of split annular adaptor collars are provided. Each of the adaptor collars has the same outer diameter so that any one of them can be fitted into the circular opening. Each of the adaptor collars has an outer circumferential sealing surface adapted to form a seal with the circular opening of the body. Each of the adaptor collars has an inner circumferential sealing surface. The size of the inner circumferential sealing surface and the distance of the inner circumferential sealing surface from the outer circumferential sealing surface varies between adaptor collars.

According to another aspect of the invention there is provided a method of use of a modular catch pan for wellheads. A first step involves providing a modular catch pan as described above. A second step involves selecting one of the plurality of adaptor collars to suit an intended installation application. The one selected will have a desired size of inner circumferential sealing surface positioned a desired distance from the outer circumferential sealing surface.

Instead of carrying a large inventory of catch pans, each with a different size of circular opening, a single size of catch pan is used in combination with an adaptor collar with dimensions to suit the intended installation.

The best known mode of applying the teachings of the present invention includes the following preferred features.

It is preferred that the adaptor collars be made from compressible foam. When the adaptor collars are compressed into position an effective seal is made along both the inner circumferential sealing surface and outer circumferential sealing surface.

It is preferred that the adaptor collars each having integral clamps adapted for clamping the adaptor collar around the wellhead. Using the integral clamps one of the adaptor collars can be clamped into the desired position on the wellhead and thereafter mated with the pan body.

It is preferred that the adaptor collars each have substantially circumferential top and bottom flanges. This both ensures that the outer circumferential sealing surface does not shift and enhances sealing of that surface.

The foam seal does not have the same rigidity as did the seal assembly used in U.S. Pat. No. 5,634,485 (1997 Holtby). It is, therefore preferred that the pan body be suspended by lines for additional support.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein:

FIG. 1 is a perspective view of a modular catch pan constructed in accordance with the teachings of the present invention.

FIG. 2 is a side elevation view of the modular catch pan illustrated in FIG. 1, attached to a wellhead on a flange below a rotating head.

FIG. 3 is a side elevation view of the modular catch pan illustrated in FIG. 1, attached to a wellhead on a spacer collar below a rotating head.

FIG. 4 is a side elevation view of the modular catch pan illustrated in FIG. 1, attached to a wellhead below a hydril.

FIG. 5 is a side elevation view of the modular catch pan illustrated in FIG. 1, attached to a wellhead on a flow nipple above a flow line.

FIG. 6 is a side elevation view of the modular catch pan illustrated in FIG. 1, attached to a wellhead on a flow nipple below a flow line.

DETAILED DESCRIPTION OF THE PREFERRED EMBODIMENT

The preferred embodiment, a modular catch pan generally identified by reference numeral 10, will now be described with reference to FIGS. 1 through 6.

Structure and Relationship of Parts

Referring to FIG. 1, there is provided a modular catch pan 10 for wellheads which includes a rigid pan body 12 that includes two detachably coupled sections 14. Body 12 has a circular opening 16. A plurality of split annular adaptor collars 18 made from compressible foam are also provided. Each of adaptor collars 18 have the same outer diameter such that any one of plurality of adaptor collars 18 can be fitted into circular opening 16 of body 12 of catch pan 10. Each adaptor collar 18 has an outer circumferential sealing surface 20 that is adapted to form a seal with circular opening 16 of body 12. Each adaptor collar 18 has substantially circumferential top and bottom flanges 22, thereby maintaining the positioning of outer circumferential sealing surface 20. Each adaptor collar also has an inner circumferential sealing surface 24. The size of inner circumferential sealing surface 24 and the distance of inner circumferential sealing surface 24 from outer circumferential sealing surface 20 varies between adaptor collars 18. Referring to FIGS. 1 and 2, each of adaptor collars 18 have integral clamps 26, whereby adaptor collars 18 are clamped around a wellhead 28. In the illustrated embodiment, one set of integral clamps 26 are provided on each adaptor collar 18 so that adaptor collar 18 can be opened in hinged fashion and then closed around wellhead 28 with integral clamps 26 securing adaptor collar 18 in position around wellhead 28. It will be appreciated that for ease of installation, integral collar 18 could be separated into two portions 30 with each portion 30 having integral clamps 28. With integral clamps 28 on each portion 30, portions 30 could then be secured together in position around wellhead 28.

Operation

The use and operation of modular catch pan 10 will now be described with reference to FIGS. 1 through 6. Referring to FIG. 1, there is illustrated a method of use of modular catch pan 10 for wellheads 28 that includes providing rigid pan body 12 which consists of two detachably coupled sections 14. As described above, body 12 of catch pan 10 has circular opening 16. Plurality of split annular adaptor collars 18 are provided that have the same outer diameter so that any one of which can be fitted into circular opening 16 of body 12 of catch pan 10. Each of adaptor collars 18 has outer circumferential sealing surface 20 adapted to form a seal with circular opening 16 of body 12, and inner circumferential sealing surface 24. Adaptor collars 18 are made from compressible foam so that as adaptor collars 18 are compressed into position, an effective seal is made along both inner circumferential sealing surface 24 and outer circumferential sealing surface 20, however it will be appreciated that other materials could be used so long as an effective seal is maintained. Flanges 22 on adaptor collars 18 ensure that outer circumferential sealing surface 20 does not shift as well as enhancing the sealing of that surface 20.

The size of inner circumferential sealing surface 24 and the distance of inner circumferential sealing surface 24 from outer circumferential sealing surface 20 varies between adaptor collars 18. This allows catch pan 10 to accommodate different installations. Depending on the type of installation, adaptor collar 18 is selected that will have a desired size of inner circumferential sealing surface 24 which is positioned a desired distance from outer circumferential sealing surface 20.

Referring to FIGS. 2 through 6, catch pan 10 is typically installed on wellhead 28 so that body 12 of catch pan 10 is suspended by lines 32 that extend from below a drilling rig floor 34 of a drilling rig 36. Referring to FIG. 1, loops 38 are provided on catch pan 10 to attach lines 32 to catch pan 10. A discharge line 40 extends from catch pan 10. Different adaptor collars 18 are then selected depending on the type of installation on wellhead 28. For example, referring to FIG. 2, catch pan 10 is installed on wellhead 28 below a rotating head 42. Referring to FIGS. 1 and 2, for this type of installation, adaptor collar 18 is selected that has a suitable size of inner circumferential sealing surface 24 and a suitable distance of inner circumferential sealing surface 24 from outer circumferential sealing surface 20 which is appropriate for the dimension of that type of installation. Referring to FIG. 3, there is illustrated catch pan 10 that is attached to wellhead 28 on a spacer collar 44 which is located below rotating head 42. Referring to FIGS. 1 and 3, given the different dimensions of spacer collar 44, a different adaptor collar 18 with a different size of inner circumferential sealing surface 24 and a different distance of inner circumferential sealing surface 24 from outer circumferential sealing surface 20 that is appropriate for the dimension of that type of installation would be selected for opening 16 in body 12 of catch pan 10. Referring to FIGS. 1 and 4, similarly, where the intended installation of catch pan 10 is on wellhead 28 below a hydril 46, then a different suitable adaptor collar 18 would be selected for opening 16 in body 12 of catch pan 10. Referring to FIGS. 1 and 5, a different adaptor collar 18 can be selected for catch pan 10 that is suitable for when catch pan 10 is attached to wellhead 28 on a flow nipple 48 above a flow line 50. Referring to FIGS. 1 and 6, where catch pan 10 is attached to wellhead 28 on flow nipple 48 below flow line 50 then it may be necessary to select another adaptor collar 18 that is more suitable for the dimensions that type of installation of catch pan 10.

The benefit of having plurality of adaptor collars 18 is that instead of carrying a large inventory of catch pans 10, each having a different size of circular opening 16, a single size catch pan 10 can be used in combination with adaptor collars 18 of suitable dimensions for differing types of installations. In this manner, catch pan 10 has greater flexibility to adapt to different installations dimensions.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A modular catch pan for wellheads, comprising:

a rigid pan body consisting of two detachably coupled sections, the body having a circular opening;

a plurality of split annular adaptor collars having the same outer diameter any one of which can be fitted into the circular opening, each of the adaptor collars having an outer circumferential sealing surface adapted to form a seal with the circular opening of the body, each of the adaptor collars having an inner circumferential sealing surface, the size of the inner circumferential sealing surface and the distance of the inner circumferential sealing surface from the outer circumferential sealing surface varying between adaptor collars.

2. The modular catch pan as defined in claim 1, wherein the adaptor collars are made from compressible foam.

3. The modular catch pan as defined in claim 1, wherein the plurality of adaptor collars each having integral clamps adapted for clamping the adaptor collar around the wellhead.

4. The modular catch pan as defined in claim 1, wherein the plurality of adaptor collars each have substantially circumferential top and bottom flanges.

5. A modular catch pan for wellheads, comprising:

a rigid pan body consisting of two detachably coupled sections, the body having a circular opening;

a plurality of split annular adaptor collars made from compressible foam, each of the adaptor collars having the same outer diameter such that any one of which can be fitted into the circular opening, each of the adaptor collars having an outer circumferential sealing surface adapted to form a seal with the circular opening of the body, each of the adaptor collars having substantially circumferential top and bottom flanges, thereby maintaining the positioning of the outer circumferential sealing surface, each of the adaptor collars having an inner circumferential sealing surface, the size of the inner circumferential sealing surface and the distance of the inner circumferential sealing surface from the outer circumferential sealing surface varying between adaptor collars, each of the adaptor collars having integral clamps, whereby the adaptor collars are clamped around the wellhead.

6. A method of use of a modular catch pan for wellheads, comprising the steps of:

providing a rigid pan body consisting of two detachably coupled sections, the body having a circular opening;

providing a plurality of split annular adaptor collars having the same outer diameter any one of which can be fitted into the circular opening, each of the adaptor collars having an outer circumferential sealing surface adapted to form a seal with the circular opening of the body, each of the adaptor collars having an inner circumferential sealing surface, the size of the inner circumferential sealing surface and the distance of the inner circumferential sealing surface from the outer circumferential sealing surface varying between adaptor collars;

selecting the one of the plurality of adaptor collars having a desired size of inner circumferential sealing surface positioned a desired distance from the outer circumferential sealing surface.

7. The method as defined in claim 6, the adaptor collars being made of compressible foam.

8. The method as defined in claim 6, the plurality of adaptor collars each having integral clamps adapted for clamping the adaptor collar around the wellhead.

9. The method as defined in claim 6, the plurality of adaptor collars each having substantially circumferential top and bottom flanges.

10. The method as defined in claim 6, the pan body being suspended by lines extending below a drilling rig.

* * * * *

UNITED STATES PATENT AND TRADEMARK OFFICE

CERTIFICATE OF CORRECTION

PATENT NO. : 6,386,225 B1
APPLICATION NO. : 09/929308
DATED : May 14, 2002
INVENTOR(S) : Quinn Holtby It is certified that error appears in the above-identified patent and that said Letters Patent is hereby corrected as shown below:

Column 1,
Line 20, "hydril" should be -- HYDRIL® --.

Signed and Sealed this

Twentieth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 6,386,225 B1
APPLICATION NO. : 09/929308
DATED : May 14, 2002
INVENTOR(S) : Quinn Holtby It is certified that error appears in the above-identified patent and that said Letters Patent is hereby corrected as shown below:

Column 1
Line 20, "HYDRIL®" should be --HYDRIL® annular blowout preventer--

Column 2,
Line 26, "hydril" should be --HYDRIL® annular blowout preventer--

Column 3,
Line 61, "hydril" should be --HYDRIL® annular blowout preventer--

Signed and Sealed this

Ninth Day of January, 2007

JON W. DUDAS
*Director of the United States Patent and Trademark Office*